United States Patent [19]

Pollard

[11] Patent Number: 4,950,846

[45] Date of Patent: Aug. 21, 1990

[54] MULTIPLE POLE ELECTRIC RELAY

[75] Inventor: David D. Pollard, Lima, Ohio

[73] Assignee: Westinghouse Electric Corp., Pittsburgh, Pa.

[21] Appl. No.: 352,436

[22] Filed: Jun. 19, 1989

[51] Int. Cl.[5] ..... H01H 1/20; H01H 15/00; H01H 67/02

[52] U.S. Cl. ..... 200/16 A; 200/243; 335/133

[58] Field of Search ..... 200/14, 16 A, 243, 245; 335/126, 131, 133, 192, 194; 361/386, 388, 389

[56] References Cited

U.S. PATENT DOCUMENTS

| | | | |
|---|---|---|---|
| 985,509 | 2/1911 | Carpenter | 388/858 |
| 1,569,374 | 1/1926 | Johnston | 200/18 |
| 1,689,075 | 10/1928 | Lehman | 335/126 |
| 1,844,731 | 2/1932 | Whittingham | 200/16 A |
| 2,266,536 | 12/1941 | Cooper | 335/126 |
| 2,514,913 | 7/1950 | Tyrner | 200/16 A |
| 2,521,973 | 9/1950 | Hamilton | 200/16 A X |
| 2,794,093 | 5/1957 | Morschel | 335/131 |
| 3,230,330 | 1/1966 | Bauer et al. | 335/126 |
| 3,258,548 | 6/1966 | Cartier et al. | 200/243 X |

*Primary Examiner*—J. R. Scott

*Attorney, Agent, or Firm*—R. P. Lenart

[57] ABSTRACT

An electric relay is provided with pairs of stationary electrical contacts for connection to an electric circuit, movable bus bars positioned at axially spaced locations along an actuating shaft, and a mechanism for moving the shaft in an axial direction between first and second positions. Compressible biasing assemblies are positioned along the shaft between the conductive members and stops are positioned at the axially spaced locations to limit movement of the compressible biasing assemblies. The conductive members have an opening for receiving the stops and are capable of axial displacement with respect to the stops. Movement of the actuating shaft compresses each of the biasing assemblies between one of the stops and one of the conductive members thereby providing an axial force to press the conductive members against a pair of stationary contacts. When the shaft is moved to a second position, a stop is forced against the other end of the biasing assemblies such that a force is exerted on the movable conductive members in an opposite direction to force them into contact with a second set of stationary contacts.

7 Claims, 4 Drawing Sheets

MULTIPLE POLE ELECTRIC RELAY

BACKGROUND OF THE INVENTION

This invention relates to multiple pole electric relays, and, more particularly, to such relays which are used to reconfigure deenergized electric circuits.

Certain electric circuits, such as those found in aircraft electrical systems offering both start and generate features, require different connections to perform different functions. The switching required to reconfigure such circuits can, in some instances, be accomplished while the circuits are deenergized. In complex circuits, such switching is typically accomplished through the use of several relays or contactors. Commonly available contactors are designed to switch energized circuits and therefore include special contacts to aid in extinguishing arcs. Contactor cooling is typically accomplished via conduction of heat through the contactor terminals and into the connected bus cables. To achieve proper circuit reconfiguration, either all or none of the contactors must switch appropriately.

For switching relatively complex, deenergized circuits, it is therefore desirable to provide a single multiple pole relay which can perform all of the required switching without the need for arc extinguishing structures.

SUMMARY OF THE INVENTION

Relays constructed in accordance with the present invention include a plurality of pairs of stationary electrical contacts for connection to an external electric circuit and a plurality of conductive members for shorting the pairs of contacts. The conductive members are positioned at axially spaced locations along an actuating rod or shaft to form an armature assembly which is operable to move between first and second positions to achieve the desired switching function for circuit reconfiguration. Compressible biasing assemblies are positioned along the shaft between the conductive members and stops are provided at the axially spaced locations along the shaft. Each of the conductive members has an opening for receiving one of the stops and is capable of axial displacement with respect to the adjacent stop. When the actuating shaft is in the first position, each of the conductive members is in contact with one of the pairs of stationary terminals and each of the biasing assemblies is in contact with one of the stops and one of the conductive elements. When the shaft is in the second position, each of the conductive members is in contact with an alternate pair of stationary terminals and each of the biasing assemblies is then in contact with a second one of the stops and a second one of the conductive elements.

The conductive elements are free to move axially in relation to the shaft but bear against one of the biasing assemblies at all times. As the shaft moves in either direction from center, the movable conductive elements move with it until they make contact with the stationary contacts. The conductive elements stop moving at that time but movement of the shaft continues. As the shaft continues to move, the biasing assemblies press against adjacent stops which move with the shaft, thereby providing a biasing force against the conductive elements. This assures adequate contact mating force and good electrical conductivity between the conductive elements and stationary terminals.

BRIEF DESCRIPTION OF THE DRAWINGS

The invention will become more readily apparent from the following description of the preferred embodiment thereof, shown by way of example only, in the accompanying drawings wherein.

DESCRIPTION OF THE PREFERRED EMBODIMENT

Figure 1:
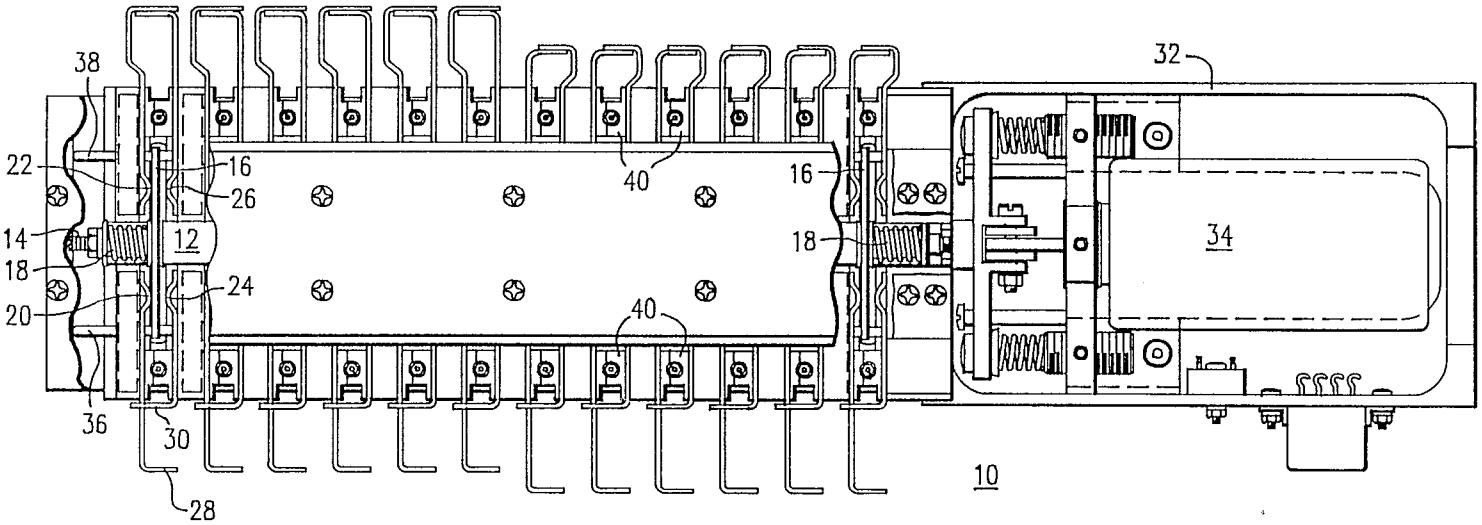
FIG. 1 is a top view of a relay constructed in accordance with one embodiment of the present invention.

Referring to the drawings, FIG. 1 is a top view of a relay 10 constructed in accordance with the preferred embodiment of the present invention. The relay includes an armature assembly 12 having a shaft 14 and a plurality of movable bus bars in the form of conductive elements 16 which are positioned at axially spaced locations along the shaft. Biasing assemblies 18 are positioned at opposite ends of the armature and also between each of the conductive elements 16. A plurality of stationary contact pairs, for example contacts 20 and 2, and contacts 24 and 26, are provided for connection to an external circuit by way of bus bars 28 and 30 and are positioned to make mechanical and electrical contact with the movable conductive elements as the armature assembly is shifted between two positions by an actuating means 32 that includes a solenoid 34. A pair of shafts 36 and 38 extend along the armature assembly and through openings in the conductive elements to prevent rotation of the conductive elements about the shaft 14. Shafts 36 and 38 also provide support, as a bearing, for the conductive elements through the entire armature assembly. Wedge assemblies 40 are used to press the stationary bus bars connected to the contacts against vertical fingers of a base structure to provide convection and conduction cooling of the bus bars via a large flat surface of the base.

Figure 2:
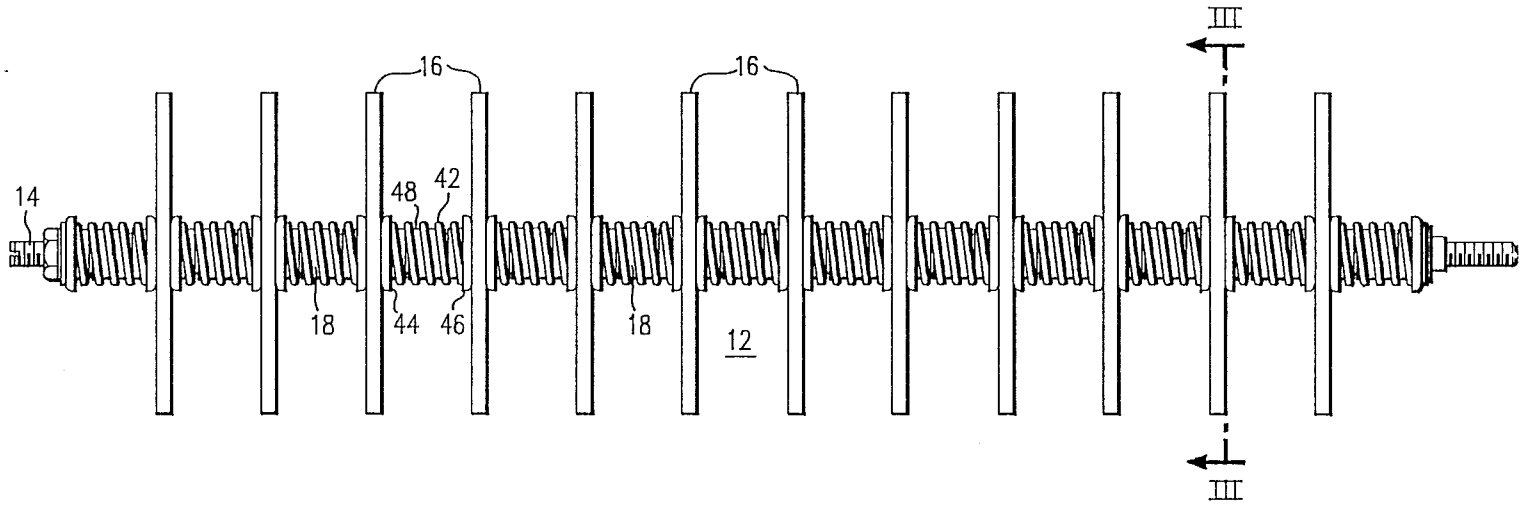
FIG. 2 is a top view of the armature assembly of the relay of FIG. 1.
Figure 3:
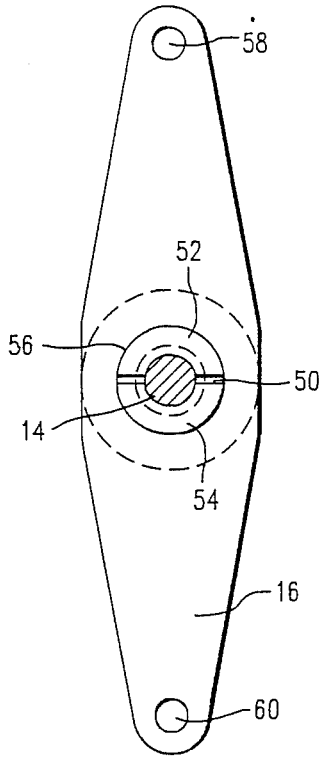
FIG. 3 is an end view of one of the conductive elements of the armature assembly of FIG. 2 taken along line III—III.

FIG. 2 is a side view of the armature assembly 12 of the relay of FIG. 1. Each of the biasing assemblies is shown to include a spring 42, a pair of spring holders 44 and 46 positioned along the shaft 14 and at opposite ends of the spring, and a sleeve 48 positioned between the spring holders. The spring holders and sleeve are free to move axially along the shaft between the axially displaced locations of the conductive elements 16. However, as illustrated in FIG. 3, at each of these actually spaced locations, the shaft 14 includes a radial groove 50 which accepts a pair of split rings 52 and 54. An opening 56 in the conductive element 16 accepts the split rings and permits axial movement of the conductive elements 16 with respect to the split rings. The split rings form a stop which prevents further axial movement of the spring biasing assemblies. FIG. 3 also shows that the conductive elements include two openings 58 and 60 for receiving shafts 36 and 38 in FIG. 1 to prevent rotation of the conductive element about shaft 14.

Figure 4:
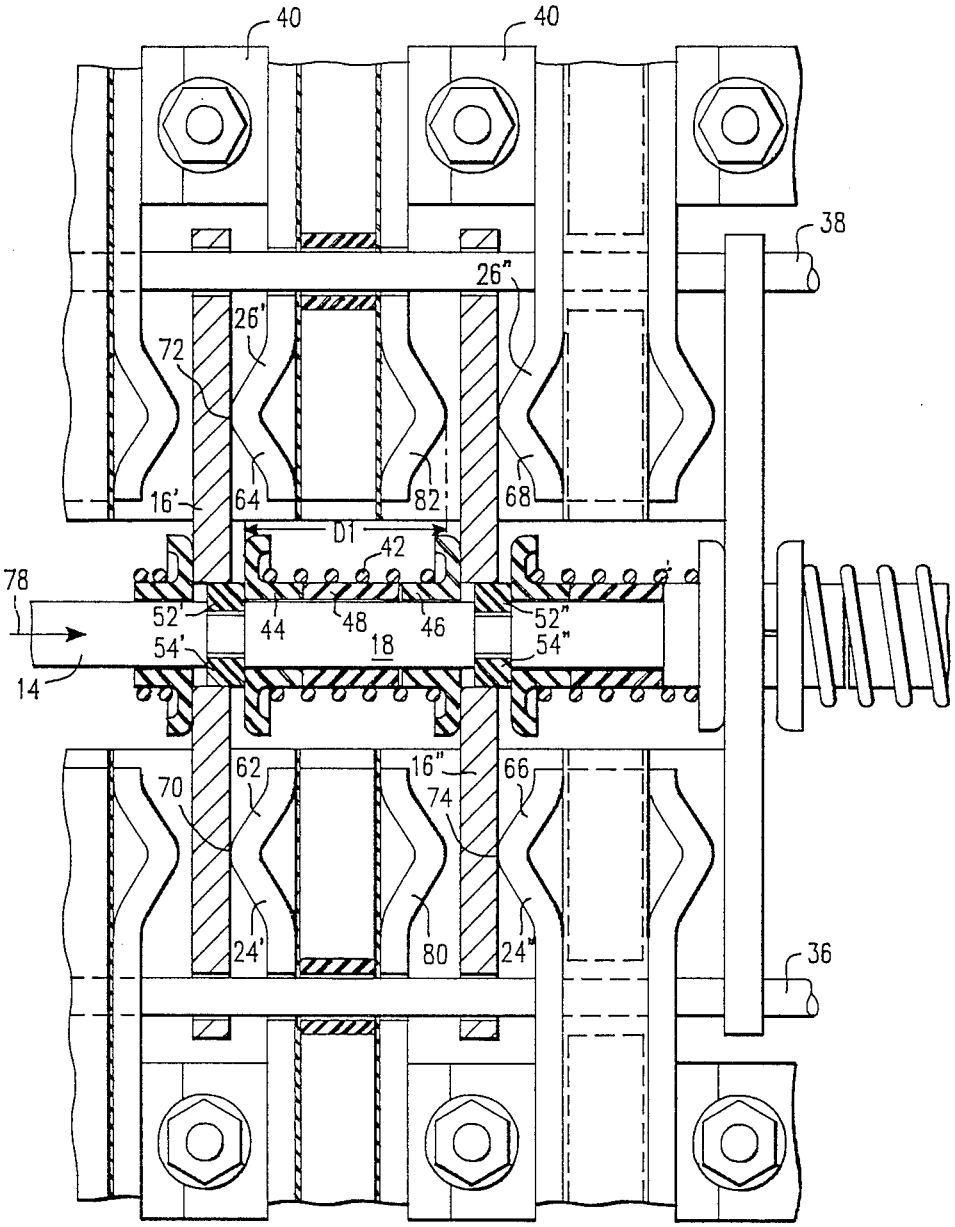
FIGS. 4 and 5 are enlarged side views, partially in section, of a portion of the armature and contact assemblies of the relay of FIG. 1.
Figure 5:
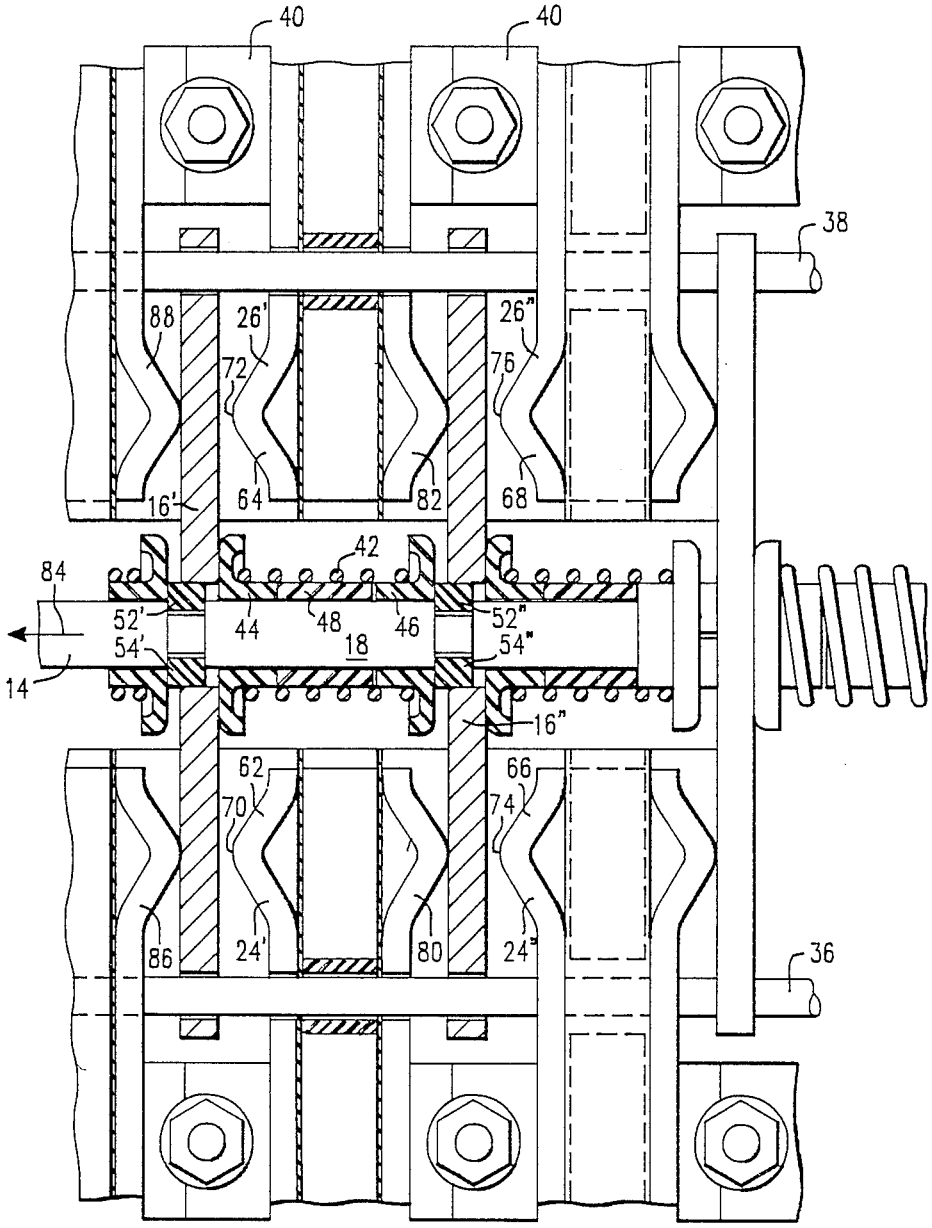

FIGS. 4 and 5 are enlarged views of a portion of the armature and contact components of the relay of FIG.

1. In these figures, primed and double primed numbers are used to distinguish between similar components. These figures clearly illustrate that contacts 24', 26', 24'', and 26'' include a generally chevron shaped offset portion 62, 64, 66 and 68 respectively, having an apex 70, 72, 74 and 76 respectively forming a line wherein contact with one of the conductive elements occurs. In FIG. 4, when the shaft 14 is moved in the direction indicated by arrow 78, conductive element 16' moves to the left along with the shaft until it makes contact with contacts 24' and 26'. At this point, lateral movement of conductive element 16' ceases but movement of the shaft 14 continues such that split rings 52' and 54' compress the spring 42 in biasing assembly 18 and apply pressure in the axial direction to conductive element 16'' thereby forcing it into electrical and mechanical contact with contacts 24'' and 26''. The dimensions of spring retainers 44 and 46 and sleeve 48 are chosen such that the minimum axial length of biasing assembly 18 is greater than D1. This ensures that movement of the shaft 14 will positively disengage conductive element 16'' from contacts 80 and 82.

FIG. 5 illustrates the positions of the relay elements when the shaft 14 is moved to a second position by moving it in the direction illustrated by arrow 84. In this case, the split rings 52', 54', 52'' and 54'' continue moving to the left after the conductive element 16' and 16'' have made contact with contacts 86 and 88, and 82 and 80, respectively.

Figure 6:
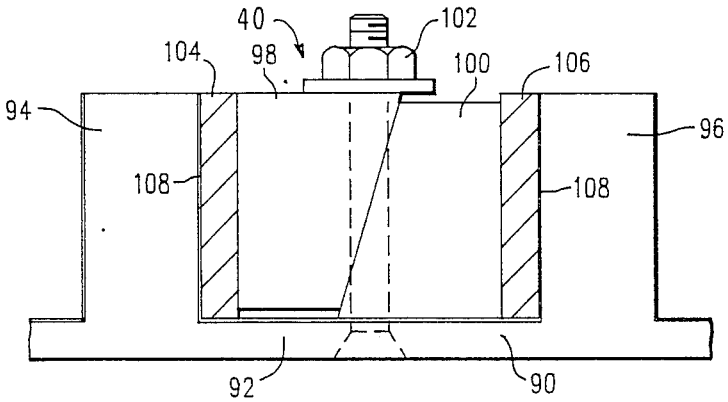
FIG. 6 is a side view of the bus bar wedging structure of the relay of FIG. 1.

FIG. 6 is a side view of one of the bus bar wedging assemblies 40 of the relay of FIG. 1. A base 90 having a generally flat portion 92 is positioned under the relay armature and contact assemblies. A plurality of projections 94 and 96 extend upward from the flat portion. Wedges 98 and 100 of an insulating material are inserted between the projections and secured by a bolt 102 to force bus bars 104 and 106 into thermal contact with the projections. Insulation 108 is provided to electrically isolate the bus bars from the base.

As illustrated in the drawings, the preferred embodiment of this invention is a twelve pole double throw relay which includes twelve conductive elements in the form of movable bus bars 16, on a single armature 12 to make contact with twenty-four pairs of stationary contacts 20, 22. Cooling of the bus bars is provided via conduction to the relay base plate 90. Movable bus bar over travel is realized via a mechanism of split ring stops that drive over travel springs 42 in the biasing assemblies 18. All movable bus bars are in axial alignment versus the parallel arrangement commonly found in power relays.

The movable bus bars 16 are free to move axially in relation to the shaft 14, however, they bear against one of the spring holders 44, 46 in the biasing assemblies at all times. The biasing assembly spring holders 44, 46 are restricted in movement by split ring stops 50, 52 which are captive in recessed radial grooves in the shaft. As the shaft moves in either direction from center, the movable bus bars move with it until they make contact with the stationary contacts 20, 22. The bus bar essentially stops moving at that time but deflects a small amount thereby causing a wiping action on the line of contact at the apex of the stationary contacts. This action serves to clean the contact surfaces. As the shaft continues movement, the split ring stops 50, 52 press against the adjacent spring holders of the biasing assemblies which move with the shaft and cause the springs to be compressed against the opposite spring holder which bears against a movable bus bar.

By using a plurality of axially spaced stops along the armature shaft in combination with the spring biasing assemblies to position the movable bus bars 16, dimensional tolerances are not cumulative. A fail safe feature is provided by using a sleeve 48 in the biasing assemblies 18 to insure a minimum length of those assemblies. If one bus bar sticks or welds to its associated stationary contacts, the relay cannot transfer. Since a single solenoid 34 operates all of the bus bars, any malfunction of the solenoid is inherently failsafe. In the preferred embodiment, the surfaces of the stationary contacts are silver plated. The bus bars 16 maya be constructed of a variety of conductive materials, with aluminum being preferred because of its high conductivity to weight ratio. The heat generated in the bus bars and the contacting surfaces of the stationary contacts is removed by way of conduction to the relay base 90 where it is removed via convection or conduction off of the large flat surface of the base. Each stationary bus bar 104, 106 is pressed against a vertical finger 94, 96 of the base by insulating wedges 98, 100 that are clamped with screws and nuts. An electrical insulating film is provided between each stationary contact bus bar and the base. The shaft bearings which prevent rotation of the movable conductive elements are made from an insulating material which has good wear characteristics, such as glass reinforced epoxy.

Although the present invention has been described in terms of what is at present believed to be its preferred embodiment, various changes may be made without departing from the scope of the invention. It is therefore intended that the appended claims cover such changes.

What is claimed is:

1. A relay comprising:

a plurality of pairs of stationary electrical contacts for connection to an electric circuit;

an actuating shaft;

a plurality of conductive members, positioned at axially spaced locations along said shaft;

means for moving said shaft in an axial direction between first and second positions;

a plurality of compressible biasing assemblies positioned along said shaft between said conductive members, each of said assemblies having first and second ends;

a plurality of stops positioned at said axially spaced locations along said shaft, each of said conductive ;members having an opening for receiving one of said stops and each of said conductive members being capable of axial displacement with respect to an adjacent one of said stops;

wherein when said shaft is in said first position, each of said conductive members is in contact with a one of said pairs of said stationary electrical contacts, each of said first ends of said biasing assemblies is in contact with one of said stops and each of said second ends of said assemblies is in contact with one of said conductive members; and wherein when said shaft is in said second position, each of said conductive members is in contact with an alternate pair of said stationary electrical contacts, each of said second ends of said biasing assemblies is in contact with one of said stops and each of said first ends of said assemblies is in contact with one of said conductive members.

2. A relay as recited in claim 1, wherein each of said biasing assemblies includes:

a spring;

first and second spring retainers positioned along said shaft on opposite sides of said spring; and a sleeve positioned along said shaft between said first and second spring retainers.

3. A relay as recited in claim 1, wherein each of said stops comprises:

a pair of split rings positioned in a groove in said shaft.

4. A relay as recited in claim 1, wherein each of said stationary electrical contacts comprises:

a conductor having a generally chevron shaped offset portion wherein contact between one of said conductive members and one of said stationary electrical contacts occurs along a line formed by the apex of said offset portion.

5. A relay as recited in claim 4, wherein the minimum length of said biasing assemblies is greater than the axial distance between a first end of one of said stops when said shaft is in said first position and the apex of one of said stationary electrical contacts.

6. A relay as recited in claim 1, further comprising:

first and second rods extending through apertures in said conductive members to prevent rotation of said conductive members about said shaft.

7. A relay as recited in claim 1, further comprising:

a base having a generally flat portion and a plurality of projections extending from said base;

a plurality of wedges; and means for clamping said wedges to force said projections into thermal contact with a plurality of bus bars extending from said stationary electrical contacts.

* * * * *